US008878763B2

(12) United States Patent
Igawa

(10) Patent No.: US 8,878,763 B2
(45) Date of Patent: Nov. 4, 2014

(54) DISPLAY APPARATUS

(71) Applicant: Samsung Display Co., Ltd., Yongin (KR)

(72) Inventor: Masami Igawa, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 160 days.

(21) Appl. No.: 13/712,345

(22) Filed: Dec. 12, 2012

(65) Prior Publication Data

US 2013/0257842 A1 Oct. 3, 2013

(30) Foreign Application Priority Data

Mar. 30, 2012 (KR) ..... 10-2012-0033531

(51) Int. Cl.
*G09G 3/36* (2006.01)
*G09G 5/00* (2006.01)

(52) U.S. Cl.
CPC . *G09G 5/001* (2013.01); *G09G 3/36* (2013.01)
USPC ..... 345/98; 345/204; 345/690

(58) Field of Classification Search
CPC ..... G09G 3/3688; G09G 2320/0223; G09G 2310/0281; G09G 2310/0283
USPC ..... 345/98–100, 204–210, 690–699
See application file for complete search history.

(56) References Cited

U.S. PATENT DOCUMENTS

| | | | |
|---|---|---|---|
| 6,750,840 | B2 | 6/2004 | Morita |
| 7,760,199 | B2 | 7/2010 | An |
| 7,928,949 | B2 | 4/2011 | Kim et al. |
| 2008/0117235 | A1 | 5/2008 | Morita |
| 2008/0239184 | A1 | 10/2008 | Kim et al. |

FOREIGN PATENT DOCUMENTS

| | | |
|---|---|---|
| JP | 2001-100179 | 4/2001 |
| JP | 2004-233386 | 8/2004 |
| JP | 2009-288668 | 12/2009 |
| JP | 2010-049035 | 3/2010 |
| KR | 10-2006-0012801 | 2/2006 |
| KR | 10-2008-0089988 | 10/2008 |
| KR | 10-2011-0076086 | 7/2011 |

*Primary Examiner* — Michael Pervan
(74) *Attorney, Agent, or Firm* — H.C. Park & Associates, PLC

(57) ABSTRACT

A display apparatus includes a display panel including pixels, a gate driver to sequentially apply a gate signal to gate lines in response to a gate control signal, a first source driver to apply a first data voltage to data lines in response to a data control signal, and a second source driver disposed at an opposite side of the display panel from the first source driver with respect to the display panel. The second source driver is configured to apply a second data voltage to the data lines at every time period, at which the gate signal is applied to the gate lines, in response to the clock signal. The pixels display a gray scale in response to the first and second data voltages, and a time period of a rising edge of the clock signal is the same as a time period of a rising edge of the gate signal. In addition, the high level period of the clock signal is shorter than the high level period of the gate signal.

21 Claims, 9 Drawing Sheets

DISPLAY APPARATUS

CROSS-REFERENCE TO RELATED APPLICATION

This application claims priority from and the benefit of Korean Patent Application No. 10-2012-0033531, filed on Mar. 30, 2012, which is incorporated herein by reference for all purposes as if fully set forth herein.

BACKGROUND OF THE INVENTION

1. Field of the Invention

Exemplary embodiments of the present invention relate to a display apparatus. More particularly, exemplary embodiments of the present invention relate to a display apparatus capable of applying a data voltage to a pixel regardless of propagation delay of a data line.

2. Discussion of the Background

Various display devices such as a liquid crystal display, an organic light emitting display device, an electrowetting display device, a plasma display panel, an electrophoresis display device, etc., have been developed recently.

A display device typically includes a display panel including a plurality of pixels, a gate driver to apply a gate signal to the display panel, and a data driver to apply a data signal to the display panel. The gate signal is sequentially applied to the display panel through a plurality of gate lines, and the data signal is applied to the display panel through a plurality of data lines. Each pixel receives the data signal in response to the gate signal and displays a gray scale corresponding to the data signal.

Recently, display devices become bigger in size and are required to be equipped with higher resolution. Since the data line has resistive component, a load in the data line becomes high as the size of the display panel is increased. Accordingly, due to a propagation delay of the data line, the propagation time delay of the data signal may occur as the data signal is closer to the end of the data line.

SUMMARY OF THE INVENTION

Exemplary embodiments of the present invention provide a display apparatus capable of applying a data voltage to a pixel regardless of propagation delay of a data line.

Additional features of the invention will be set forth in the description which follows, and in part will be apparent from the description, or may be learned by practice of the invention.

An exemplary embodiment of the present invention provides a display apparatus that includes a display panel including a plurality of gate lines, a plurality of data lines, and a plurality of pixels connected to the gate lines and the data lines, a timing controller to generate a gate control signal, a data control signal, and a clock signal, a gate driver to sequentially apply a gate signal to the gate lines in response to the gate control signal, a first source driver to apply a first data voltage to the data lines in response to the data control signal, and a second source driver disposed at an opposite side of the display panel from the source driver with respect to the display panel. The second source driver is configured to apply a second data voltage to the data lines at every time period, at which the gate signal is applied to the gate lines, in response to the clock signal. The pixels display a gray scale in response to the first data voltage and the second data voltage, a time period of a rising edge of the clock signal is the same as a time period of a rising edge of the gate signal, and the clock signal has a high level period shorter than a high level period of the gate signal.

According to the above structure, the display apparatus may apply the normal data voltage to the pixels regardless of the propagation time delay of the data lines. Thus, the pixels may display the normal gray scale level corresponding to the data voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
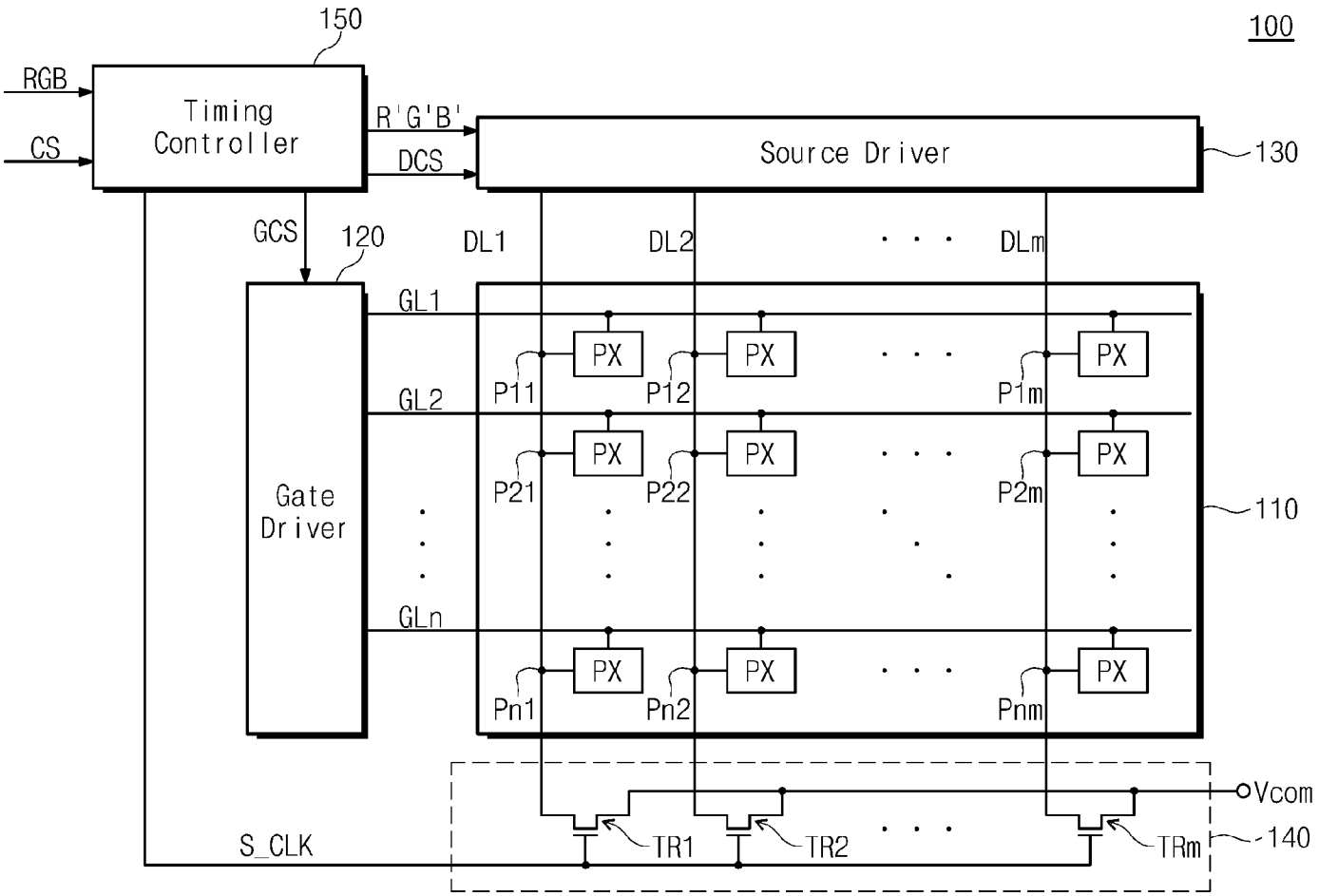
FIG. 1 is a block diagram showing a display apparatus according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

In the drawings, the thickness of layers, films, panels, regions, etc., may be exaggerated for clarity. It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. In contrast, It will be understood that when an element such as a layer, film, region, or substrate is referred to as being "beneath" another element, it can be directly beneath the other element or intervening elements may also be present. Meanwhile, when an element is referred to as being "directly beneath" another element, there are no intervening elements present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

Hereinafter, exemplary embodiments of the present invention will be described in detail with reference to the accompanying drawings.

FIG. 1 is a block diagram showing a display apparatus according to an exemplary embodiment of the present invention.

Referring to FIG. 1, a display apparatus 100 includes a display panel 110, a gate driver 120, a source driver 130, a sub-source driver 140, and a timing controller 150.

The display panel 110 includes a plurality of gate lines GL1 to GLn, a plurality of data lines DL1 to DLm crossing the gate lines GL1 to GLn, and a plurality of pixels PX arranged in areas defined by the gate lines GL1 to GLn and the data lines DL1 to DLm. The pixels PX are arranged in a matrix configuration of n rows by m columns.

Each of the data lines DL1 to DLm includes a plurality of nodes P11 to Pnm each of which is connected to a corresponding pixel of the pixels PX. That is, the nodes P11 to Pnm are arranged in n rows by m columns since the nodes P11 to Pnm are portions at which each data line is connected to the pixels PX.

The source driver 130 and the sub-source driver 140 are disposed at opposite sides of the display panel 110. For instance, as shown in FIG. 1, the source driver 130 is disposed adjacent to an upper portion of the display panel 110 and the sub-source driver 140 is disposed adjacent to a lower portion of the display panel 110.

The gate lines GL1 to GLn are connected to the gate driver 120 to receive gate signals. The data lines DL1 to DLm are connected to the source driver 130 to receive data voltages. In addition, the data lines DL1 to DLm are connected to the sub-source driver 140 to receive a common voltage Vcom. The data voltages may be defined as a first data voltages and the common voltage Vcom may be defined as a second data voltage.

The timing controller 150 receives image signals RGB and a control signal CS from an external source. The timing controller 150 converts a data format of the image signals RGB to a data format appropriate to an interface between the source driver 130 and the timing controller 150 and provides the converted image signals R'G'B' to the source driver 130.

In addition, the timing controller 150 generates a data control signal DCS, a gate control signal GCS, and a sub-clock signal S_CLK in response to the control signal CS. The timing controller 150 applies the data control signal DCS to the source driver 130 and applies the gate control signal GCS to the gate driver 120. In addition, the timing controller 150 applies the sub-clock signal S-CLK to the sub-source driver 140.

The gate driver 120 sequentially outputs the gate signals in response to the gate control signal GCS from the timing controller 150. The gate signals are sequentially applied to the pixels PX through the gate lines GL1 to GLn such that the pixels PX are driven in the unit of row.

The source driver 130 converts the image signals R'G'B' to the data voltages in response to the data control signal DCS from the timing controller 150. The data voltages are applied to the pixels PX through the data lines DL1 to DLm.

The sub-source driver 140 includes a plurality of transistors TR1 to TRm respectively corresponding to the data lines DL1 to DLm. Each drain electrode of the transistors TR1 to TRm is connected to a corresponding data line of the data lines DL1 to DLm, each gate electrode of the transistors TR1 to TRm is applied with the sub-clock signal S_CLK from the timing controller 150, and each source electrode of the transistor TR1 to TRm is applied with the common voltage Vcom.

The data voltages includes a positive (+) polarity data voltage and a negative (−) polarity data voltage, and the common voltage Vcom has an intermediate level between the positive (+) polarity data voltage and the negative (−) polarity data voltage.

The pixels PX receive the data voltages in response to the gate signals. The data voltages are applied to the pixels PX from the upper portion of the display panel 110, at which the source driver 130 is disposed, through the data lines DL1 to DLm.

Although not shown in FIG. 1, the data lines DL1 to DLm have resistive component. Due to the resistive component, a delay of the data voltages through the data lines DL1 to DLm becomes large as the data lines are closer to the lower portion of the display panel 110. Accordingly, a propagation time delay of the data voltages applied to the pixels PX through the data lines DL1 to DLm occurs as the data lines are closer to the lower portion. That is, the voltage at the nodes P11 to Pnm of the data lines DL1 to DLm, which are relatively spaced apart from the source driver 130, may not reach the expected potential, e.g., a target voltage level, during a high level period of the gate signals. The target voltage may be the same as the voltage level of the data voltages output from the source driver 130.

For instance, in case when the data voltages output from the source driver 130 is about 20 volts, the voltage of the nodes P11 to Pnm of the data lines DL1 to DLm, which are relatively spaced apart from the source driver 130, does not rise to about 20 volts during the high level period of the gate signals and is maintained at a voltage level lower than about 20 volts.

Since the delay of the data voltages in the data lines becomes large as the data lines are closer to the lower portion, the propagation time delay of the data voltages becomes large. Thus, the voltage level of the data voltages applied to the pixels PX may be lower than that of the positive (+) polarity data voltage output from the source driver 130. In addition, the voltage level of the data voltages applied to the pixels PX may be higher than that of the negative (−) polarity data voltage output from the source driver 130.

In this case, the pixels PX are not charged with pixel voltages corresponding to the target voltage level, so the pixels PX may not display a normal gray scale level.

However, the sub-source driver 140 outputs the common voltage Vcom at every time period when the gate signals are applied to the pixels PX in response to the sub-clock signal S_CLK. The common voltage Vcom is applied to the display panel 110 from the lower portion of the display panel 110, in which the sub-source driver 140 is disposed, through the data lines DL1 to DLm.

The common voltage Vcom is used to reduce the propagation time delay of the data voltages, and thus the voltage of the nodes P11 to Pnm reaches the target voltage level.

In detail, the transistors TR1 to TRm of the sub-source driver 140 are turned on by the sub-clock signal S_CLK at every time period when the gate signals are applied to the pixels PX. The common voltage Vcom is applied to the lower portion of the display panel 110 through the data lines DL1 to DLm by the turned-on transistors TR1 to TRm. The common voltage Vcom is output during the high level period of the sub-clock signal S_CLK.

The voltage of the nodes P11 to Pnm of the data lines DL1 to DLm, which does not have the target voltage level of the positive (+) polarity, is precharged to the level of the common voltage Vcom during the high level period of the sub-clock signal S_CLK. The voltage of the nodes P11 to Pnm precharged to the level of the common voltage Vcom rises up from the voltage level precharged to the level of the common voltage Vcom, and thus the voltage of the nodes P11 to Pnm may rise up to the target voltage level of the positive (+) polarity. That is, the voltage of the nodes P11 to Pnm may have the target voltage level.

Similarly, the voltage of the nodes P11 to Pnm of the data lines DL1 to DLm, which does not have the target voltage level of the negative (−) polarity, is precharged to the level of the common voltage Vcom during the high level period of the sub-clock signal S_CLK. Since the voltage of the nodes P11 to Pnm precharged to the level of the common voltage Vcom falls down from the voltage level precharged to the level of the common voltage Vcom, the voltage of the nodes P11 to Pnm may fall down to the target voltage level of the negative (−) polarity. That is, the voltage of the nodes P11 to Pnm may have the target voltage level.

The delay of the data line is decreased as the data line is closer to the upper portion of the display panel 110 adjacent to the source driver 130. Thus, the voltage of the nodes P11 to Pnm may have the target voltage level as the nodes P11 to Pnm are closer to the upper portion of the display panel 110 even though the nodes P11 to Pnm disposed adjacent to the upper portion of the display panel 110 are not precharged.

As a result, the voltage of the nodes P11 to Pnm may have the target voltage level. The pixels PX receive the voltage of the nodes P11 to Pnm, and are charged with the pixel voltage corresponding to the voltage of the nodes P11 to Pnm. In other words, the pixels PX display the gray scale corresponding to the target voltage. The voltage of the nodes P11 to Pnm may be defined as a gray scale-driving voltage for the gray scale displayed by the pixels PX. Application timings of the gate signals and the sub-clock signal S_CLK and the level of the voltage applied to the nodes P11 to Pnm will be described with reference to FIG. 2.

Consequently, the display apparatus 100 may apply the normal data voltage to the pixels PX regardless of the propagation time delay of the data lines DL1 to DLm. Thus, the pixels PX may display the normal gray scale level corresponding to the data voltage.

Figure 2:
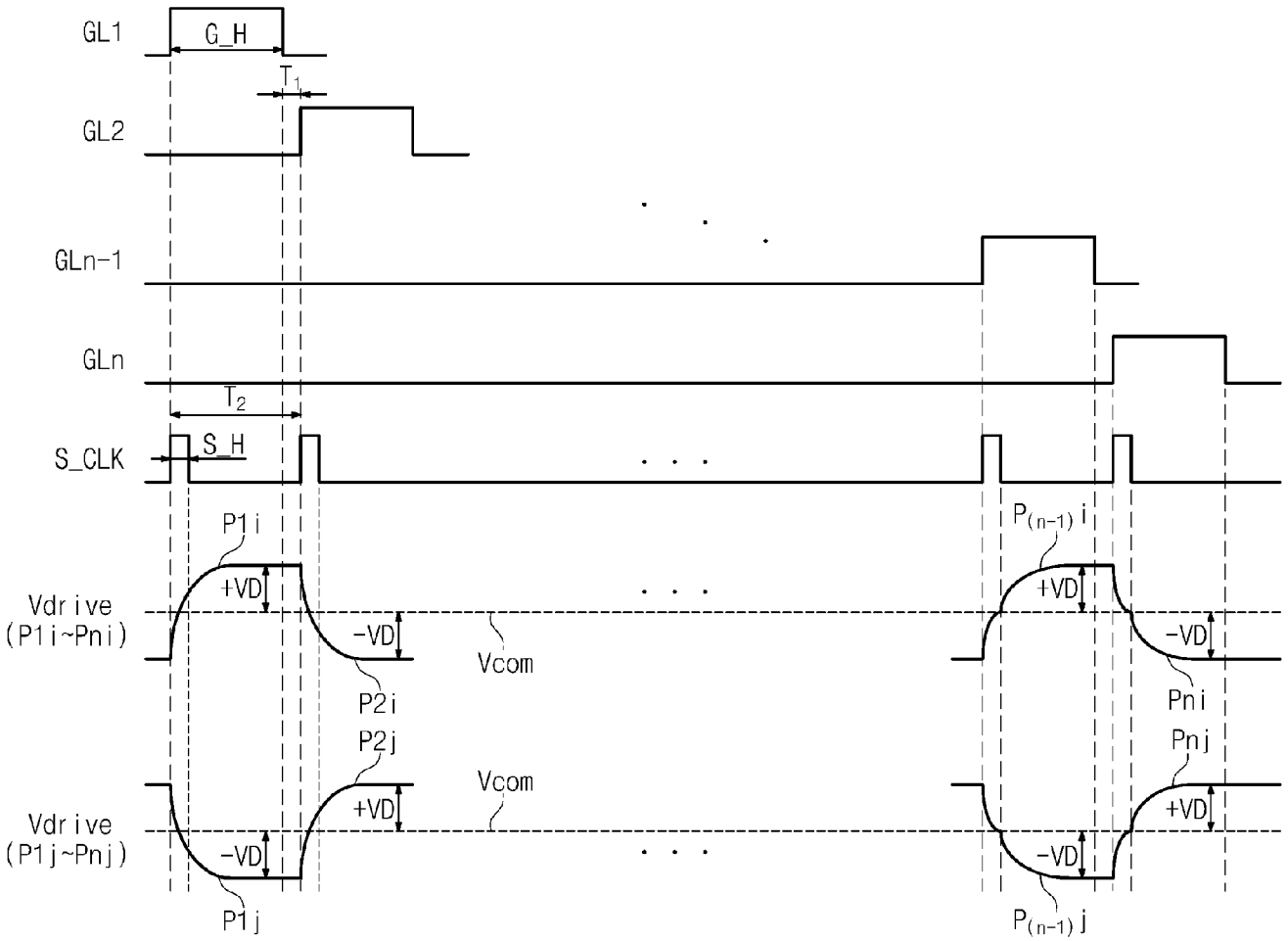
FIG. 2 is a timing diagram illustrating an operation of the display apparatus shown in FIG. 1.

FIG. 2 is a timing diagram illustrating an operation of the display apparatus shown in FIG. 1. FIG. 2 shows voltage waveforms of the gate signal, the sub-clock signal, and the nodes of the data lines in the display apparatus 100 operated in a dot-inversion driving scheme.

Referring to FIG. 2, the gate signals are sequentially applied to the gate lines GL1 to GLn. The gate signals are output at a first time interval T1 in order to prevent that the pixels PX connected to the gate lines adjacent to each other are simultaneously driven. That is, when a gate signal is applied to the pixels PX connected to a corresponding gate line in a previous stage, a gate signal is applied to the pixels PX connected to a corresponding gate line in a present stage after the time interval T1 lapses.

The source driver 130 outputs the data voltages through the data lines DL1 to DLm. Since the display apparatus 100 operates in the dot-inversion driving scheme, the data voltages having the positive (+) polarity are alternately output with the data voltages having the negative (−) polarity through the data lines DL1 to DLm. In addition, the positive (+) polarity data voltages and the negative (−) polarity data voltages are alternately output with each other through the odd-numbered data lines DL1, DL3, . . . , DLm−1 and the even-numbered data lines DL2, DL4, . . . , DLm.

For instance, the odd-numbered data lines DL1, DL3, . . . , DLm−1 alternately output the positive (+) polarity data voltages and the negative (−) polarity data voltages, and the even-numbered data lines DL2, DL4, . . . , DLm alternately output the negative (−) polarity data voltages and the positive (+) polarity data voltages. When the odd-numbered data lines DL1, DL3, . . . , DLm−1 output the positive (+) polarity data voltages, the even-numbered data lines DL2, DL4, . . . , DLm output the negative (−) polarity data voltages. On the contrary, when the odd-numbered data lines DL1, DL3, . . . , DLm−1 output the negative (−) polarity data voltages, the even-numbered data lines DL2, DL4, . . . , DLm output the positive (+) polarity data voltages.

The data voltages output from the source driver 130 are applied to the pixels PX during the high level period G_H of the gate signal. In detail, the voltage of each node P11 to Pnm of the data lines DL1 to DLm is applied to the pixels PX as the gray scale-driving voltage.

The sub-clock signal S_CLK applied to the sub-source driver 140 from the timing controller 150 has a period T2 from a rising edge of the high level period G_H of the gate signal in the present stage to a rising edge of the high level period G_H of the gate signal in a next stage. In addition, the high level period S_H of the sub-clock signal S_CLK is set shorter than the high level period G_H of the gate signal. The duration of the rising edge of the sub-clock signal S_CLK is substantially the same as the duration of the rising edge of the high level period G_H of each gate signal.

Therefore, the sub-source driver 140 outputs the common voltage Vcom at every time period, at which the gate signals are applied to the pixels PX, in response to the sub-clock signal S_CLK. The common voltage Vcom is applied to the lower portion of the display panel 110 from the sub-source driver 140 through the data lines DL1 to DLm.

The nodes P1*i* to Pni shown in FIG. 2 are included in one odd-numbered data line of the odd-numbered data lines DL1, DL3, . . . , DLm−1, and the nodes P1*j* to Pnj shown in FIG. 2 are included in one even-numbered data line of the even-numbered data lines DL2, DL4, . . . , DLm.

Since the data voltages having opposite polarities to each other are alternately output from the data lines DL1 to DLm, the gray scale-driving voltage Vdrive of the nodes P1*i* to Pni of the odd-numbered data lines alternately has the positive (+) polarity and the negative (−) polarity, and the gray scale-driving voltage Vdrive of the nodes P1*j* to Pnj of the even-numbered data lines alternately has the negative (−) polarity and the positive (+) polarity. In the present exemplary embodiment, i is an odd integer that is larger than zero and equal to or smaller than m−1, j is an even integer that is larger than zero and equal to or smaller than m.

As described above, when the data voltages having opposite polarities to each other are output through the odd-numbered data lines DL1, DL3, . . . , DLm−1 and the even-numbered data lines DL2, DL4, . . . , DLm, the nodes P1*i* to Pni of the odd-numbered data line have the polarity opposite to the polarity of the nodes P1*j* to Pnj of the even-numbered data line.

The gray scale-driving voltage of the nodes P11 to Pnm of the data lines DL1 to DLm is applied to the pixels PX during the high level period G_H of the gate signal.

As described above, the propagation time delay of the data lines is reduced as the data lines are closer to the upper portion of the display panel 110, and the propagation time delay of the data lines is shortened at first nodes P1*i* and P1*j* of the data lines DL1 to DLm.

Accordingly, as shown in FIG. 2, the gray scale-driving voltage Vdrive of the first node P1*i* of the odd-numbered data line may rise up to the target voltage +VD of the positive (+) polarity during the high level period G_H of the gate signal. In addition, as shown in FIG. 2, the gray scale-driving voltage Vdrive of the first node P1*j* of the even-numbered data line may fall down to the target voltage −VD of the negative (−) polarity during the high level period G_H of the gate signal.

The voltage of the first nodes P1*i* and P1*j* rises up to the positive (+) polarity voltage higher than the common voltage Vcom or falls down to the negative (−) polarity voltage lower than the common voltage Vcom before the high level period S_H of the sub-clock signal S_CLK ends. Thus, the first nodes P1*i* and P1*j* are not precharged to the level of the common voltage Vcom provided from the sub-source driver 140.

As described above, the propagation time delay of the data lines is increased as the data lines are closer to the lower portion of the display panel 110. The propagation time delay of the data lines is maximized at last nodes Pni and Pnj (hereinafter, referred to as n-th nodes) of the data lines DL1 to DLm. However, the common voltage Vcom is output through the data lines during the high level period S_H of the sub-clock signal S_CLK.

Accordingly, as shown in FIG. 2, the gray scale-driving voltage Vdrive of the n-th node Pni of the odd-numbered data line is precharged to the level of the common voltage Vcom during the high level period S_H of the sub-clock signal S_CLK. In addition, as shown in FIG. 2, the gray scale-driving voltage Vdrive of the n-th node Pnj of the even-numbered data line is precharged to the level of the common voltage Vcom during the high level period S_H of the sub-clock signal S_CLK.

The high level period S_H of the sub-clock signal S_CLK may be set to a time period during which the n-th nodes Pni and Pnj are precharged to the level of the common voltage Vcom.

The gray scale-driving voltage Vdrive of the n-th node Pni of the odd-numbered data line may fall down from the voltage level percharged to the level of the common voltage Vcom. In addition, the gray scale-driving voltage Vdrive of the n-th node Pnj of the even-numbered data line may rise up from the voltage level percharged to the level of the common voltage Vcom.

Thus, as shown in FIG. 2, the gray scale-driving voltage Vdrive of the n-th node Pni of the odd-numbered data line may fall down to the negative (−) polarity target voltage −VD during the high level period G_H of the gate signal. In addition, as shown in FIG. 2, the gray scale-driving voltage Vdrive of the n-th node Pnj of the even-numbered data line may rise up to the positive (+) polarity target voltage +VD during the high level period G_H of the gate signal.

Consequently, the nodes P11 to Pnm of the data lines DL1 to DLm applied with the positive (+) polarity data voltages have the voltage level equal to or higher than the common voltage Vcom during the high level period S_H of the sub-clock signal S_CLK. In addition, the nodes P11 to Pnm of the data lines DL1 to DLm applied with the positive (+) polarity data voltages have the positive (+) polarity target voltage +VD substantially the same as the positive (+) polarity data voltage during the high level period G_H of the gate signal.

The nodes P11 to Pnm of the data lines DL1 to DLm applied with the negative (−) polarity data voltages have the voltage level equal to or lower than the common voltage Vcom during the high level period S_H of the sub-clock signal S_CLK. In addition, the nodes P11 to Pnm of the data lines DL1 to DLm applied with the negative (−) polarity data voltages have the negative (−) polarity target voltage −VD substantially the same as the negative (−) polarity data voltage during the high level period G_H of the gate signal.

The pixels PX receive the gray scale-driving voltage Vdrive of the nodes P11 to Pnm, which falls down to the negative (−) polarity target voltage −VD or rises up to the positive (+) polarity target voltage +VD, and display the gray scale level corresponding to the gray scale-driving voltage Vdrive.

The data voltages are applied to the upper portion of the display panel 110 through the data lines DL1 to DLm and the common voltage Vcom is applied to the lower portion of the display panel 110 through the data lines DL1 to DLm. Therefore, the display apparatus 100 may reduce the occurrence of the propagation time delay of the data voltages, which is caused by the delay of the data lines DL1 to DLm.

Figure 3A:
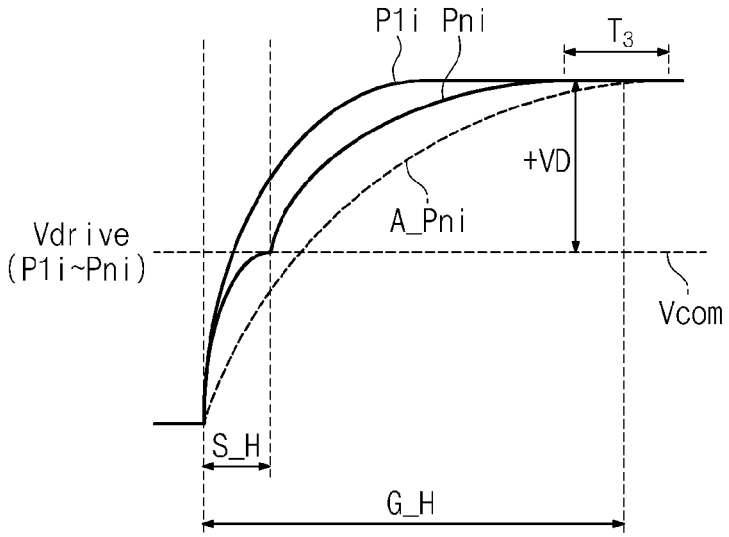
FIG. 3A is an enlarged waveform diagram showing a voltage waveform at a first node and an n-th node of odd-numbered data lines shown in FIG. 2.
Figure 3B:
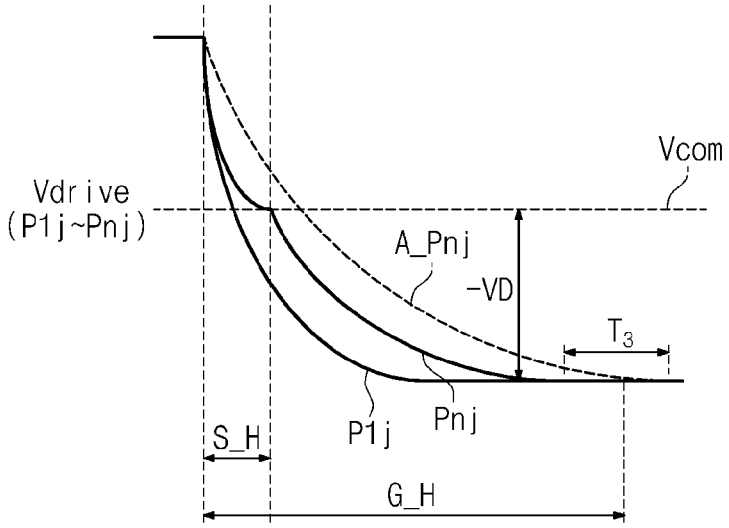
FIG. 3B is an enlarged waveform diagram showing a voltage waveform at a first node and an n-th node of even-numbered data lines shown in FIG. 2.

FIG. 3A is an enlarged waveform diagram showing a voltage waveform of the first node and the n-th node of odd-numbered data lines shown in FIG. 2, and FIG. 3B is an enlarged waveform diagram showing a voltage waveform of the first node and the n-th node of even-numbered data lines shown in FIG. 2. FIG. 3A and FIG. 3B show the voltage waveform of the n-th nodes A_Pni and A_Pnj of the odd-numbered data line and the even-numbered data line when assuming that the display apparatus 100 does not include the sub-source driver 140.

Referring to FIG. 3A, the gray scale-driving voltage Vdrive of the first node P1*i* of the odd-numbered data line rises up to the level higher than the common voltage Vcom before the high level period S_H of the sub-clock signal S_CLK ends. In addition, the gray scale-driving voltage Vdrive of the first node P1*i* of the odd-numbered data line rises up to the level of the positive (+) polarity target voltage +VD during the high level period G_H of the gate signal.

In case the display apparatus 100 does not include the sub-source driver 140, the gray scale-driving voltage Vdrive of the n-th node A_Pni of the odd-numbered data line may not rise up to the level higher than the common voltage Vcom during the high level period S_H of the sub-clock signal S_CLK. In addition, the gray scale-driving voltage Vdrive of the n-th node A_Pni of the odd-numbered data line does not rise up to the level of the positive (+) polarity target voltage +VD during the high level period G_H of the gate signal and rises up to the level of the positive (+) polarity target voltage +VD after the high level period G_H of the gate signal ends.

In case the display apparatus 100 includes the sub-source driver 140, the common voltage Vcom is applied to the lower portion of the display panel 110 through the data lines DL1 to DLm. Accordingly, the gray scale-driving voltage Vdrive of the n-th node Pni of the odd-numbered data line may rise up to the level of the common voltage Vcom during the high level period S_H of the sub-clock signal S_CLK. In addition, the gray scale-driving voltage Vdrive of the n-th node Pni of the odd-numbered data line may rise up to the level of the positive (+) polarity target voltage +VD during the high level period G_H of the gate signal.

As a result, as shown in FIG. 3A, a time period during which the gray scale-driving voltage Vdrive of the n-th node Pni of the odd-numbered data line rises to the level of the positive (+) polarity target voltage +VD may be reduced by a time interval T3 when compared with that when the display apparatus 100 does not include the sub-source driver 140.

The waveform shown in FIG. 3B is substantially the same as that of FIG. 3A except for polarities. Thus, details of FIG. 3B will be omitted.

Consequently, the display apparatus 100 may provide the pixels PX with the normal data voltage regardless of the propagation time delay of the data voltages. Accordingly, the pixels PX may display the normal gray scale level corresponding to the data voltage.

Figure 4:
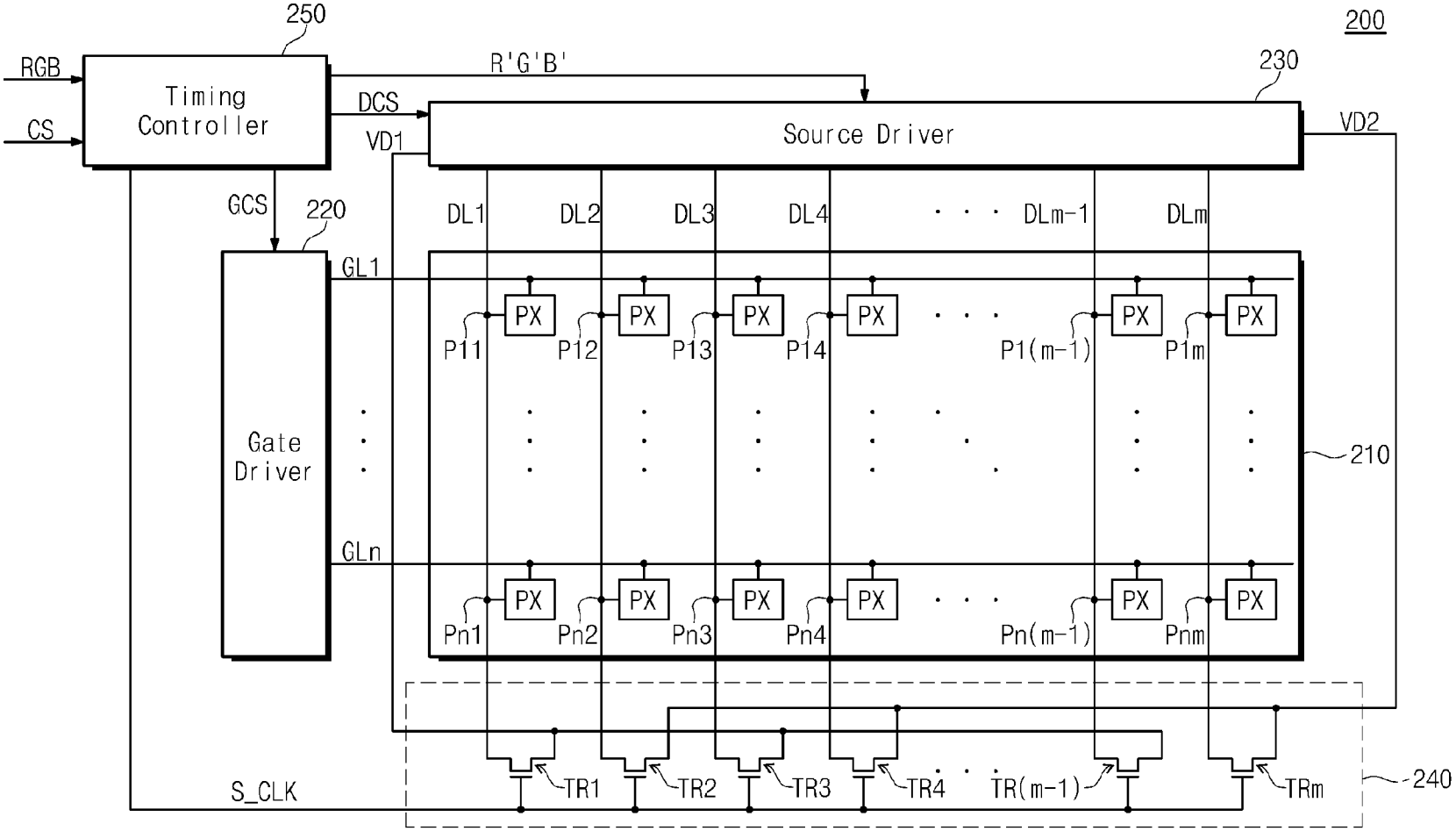
FIG. 4 is a block diagram showing a display apparatus according to another exemplary embodiment of the present invention.

FIG. 4 is a block diagram showing a display apparatus according to another is exemplary embodiment of the present invention.

Referring to FIG. 4, a display apparatus 200 includes a display panel 210, a gate driver 220, a source driver 230, a sub-source driver 240, and a timing controller 250.

The display apparatus 200 has the same configuration and function as those of the display apparatus 100 shown in FIG. 1 except the source driver 230 and the sub-source driver 240. Accordingly, different configuration and function from those of the display apparatus 100 shown in FIG. 1 will be largely described and the display apparatus 200 operates in the dot-inversion driving scheme.

The source driver 230 outputs a first voltage VD1 and a second voltage VD2, which have opposite polarities to each other, to the sub-source driver 240 and outputs the data voltages to the display panel 210 through the data lines DL1 to DLm. Since the display apparatus 200 operates in the dot-inversion driving scheme, the data voltages having opposite polarities to each other are alternately output through the data lines DL1 to DLm. In addition, the data voltages output through the odd-numbered data lines DL1, DL3, . . . , DLm−1 have the polarity opposite to the polarity of the data voltages output through the even-numbered data lines DL2, DL4, . . . , DLm.

The first voltage VD1 has the same level and the same polarity as the data voltages output through the odd-numbered data lines DL1, DL3, . . . , DLm−1 from the source driver 230. The second voltage VD2 has the same level and polarity as the data voltages output through the even-numbered data lines DL2, DL4, . . . , DLm from the source driver 230.

The first voltage VD1 is applied to source electrodes of odd-numbered transistors TR1, TR3, . . . , TRm−1 of the sub-source driver 240. The second voltage VD2 is applied to source electrodes of even-numbered transistors TR2, TR4, . . . , TRm of the sub-source driver 240.

The transistors TR1 to TRm of the sub-source driver 240 are turned on by the sub-clock signal S_CLK at every time period when the gate signals are applied to the pixels. The first voltage VD1 is applied to the lower portion of the display panel 210 by the turned-on odd-numbered transistors TR1, TR3, . . . , TRm−1 through the odd-numbered data lines DL1, DL3, . . . , DLm−1. The second voltage VD2 is applied to the lower portion of the display panel 210 by the turned-on even-numbered transistors TR2, TR4, . . . , TRm through the even-numbered data lines DL2, DL4, . . . , DLm.

Since the delay of the data voltages is increased as the data lines are closer to the lower portion of the display panel 210, the propagation time delay of the data voltages becomes large. However, the sub-source driver 240 outputs the first voltage VD1 and the second voltage VD2 at every time period, at which the gate signals are applied to the pixels, in response to the sub-clock signal S-CLK. The first voltage VD1 and the second voltage VD2 are output during the high level period of the sub-clock signal S_CLK.

Since the delay of the data voltages is increased as the data lines are closer to the lower portion of the display panel 210, the propagation time delay of the data voltages becomes large. Accordingly, the data voltages having the level lower than the positive (+) polarity data voltage output from the source driver 230 and the data voltages having the level lower than the negative (−) polarity data voltage output from the source driver 230 may be applied to the pixels PX as the data lines are closer to the lower portion of the display panel 210.

However, the sub-source driver 240 outputs the first voltage VD1 and the second voltage VD2 at every time period, at which the gate signals are applied to the pixels, in response to the sub-clock signal S-CLK. The first voltage VD1 and the second voltage VD2 allow the voltage of the nodes P11 to Pnm to rise up to the positive (+) polarity target voltage. In addition, the first voltage VD1 and the second voltage VD2 allow the voltage of the nodes P11 to Pnm to fall down to the negative (−) polarity target voltage.

In detail, the voltage of the nodes P11 to Pnm of the data lines DL1 to DLm applied with the positive (+) polarity data voltages may be precharged to the voltage higher than the common voltage Vcom by the first and second voltages VD1 and VD2 during the high level period of the sub-clock signal S_CLK. The voltage of the nodes P11 to Pnm precharged to the voltage higher than the common voltage Vcom during the high level period of the sub-clock signal S_CLK rises up from the precharged voltage level by the data voltages provided from the source driver 230, and thus the voltage of the nodes P11 to Pnm may rise up to the target voltage level.

The voltage of the nodes P11 to Pnm of the data lines DL1 to DLm applied with the negative (+) polarity data voltages may be precharged to the voltage lower than the common voltage Vcom by the first and second voltages VD 1 and VD2 during the high level period of the sub-clock signal S_CLK. The voltage of the nodes P11 to Pnm precharged to the voltage lower than the common voltage Vcom during the high level period of the sub-clock signal S_CLK falls down from the precharged voltage level by the data voltages provided from the source driver 230, and thus the voltage of the nodes P11 to Pnm may fall down to the target voltage level.

The delay of the data line is decreased as the data line is closer to the upper portion of the display panel 210 adjacent to the source driver 230. Thus, the voltage of the nodes P11 to Pnm may have the target voltage level as the nodes P11 to Pnm are closer to the upper portion of the display panel 210.

Accordingly, the voltage of the nodes P11 to Pnm may have the target voltage level. The pixels PX receive the gray scale-driving voltage Vdrive of the nodes P11 to Pnm, which rises up to the negative (−) and positive (+) target voltages −VD and +VD, and display the gray scale level corresponding to the gray scale-driving voltage Vdrive.

Consequently, the display apparatus 200 may apply the normal data voltage to the pixels PX regardless of the propagation time delay of the data lines DL1 to DLm. Thus, the pixels PX may display the normal gray scale level corresponding to the data voltage.

Figure 5:
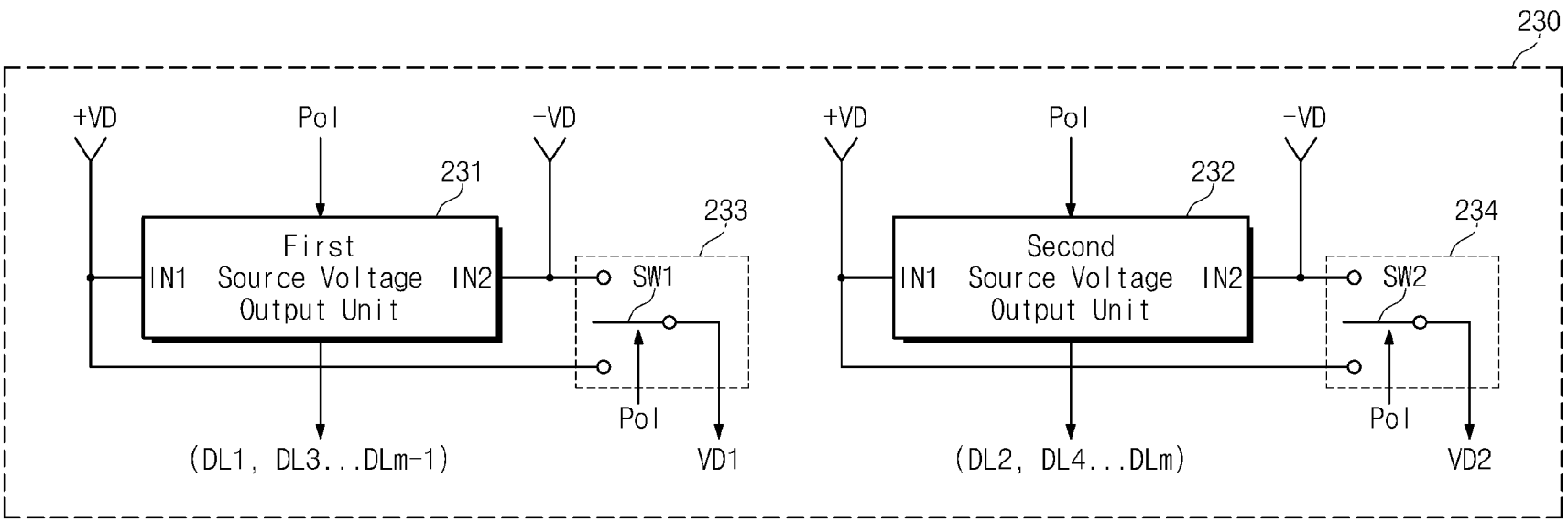
FIGS. 5 and 6 are block diagrams showing a source driver shown in FIG. 4.
Figure 6:
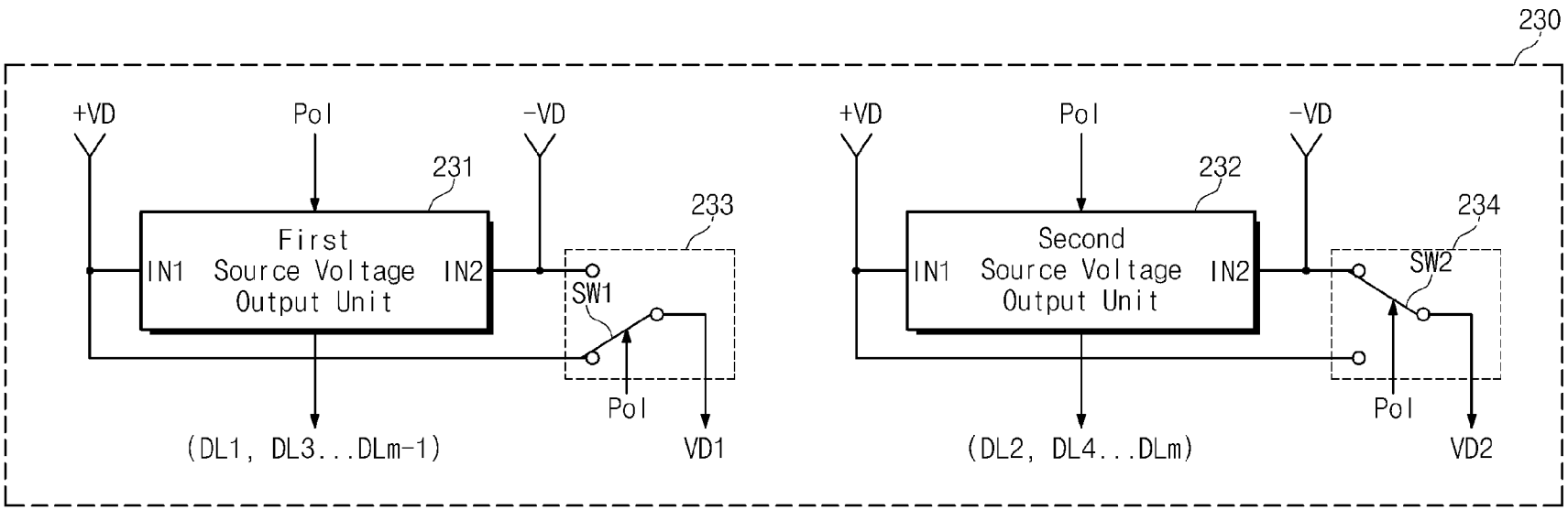

FIG. 5 and FIG. 6 are block diagrams showing a source driver shown in FIG. 4.

Referring to FIG. 5, the source driver 230 of the display apparatus 200 includes a first source voltage output unit 231, a second source voltage output unit 232, a first switch circuit 233, and a second switch circuit 234.

The data control signal DCS includes a polarity control signal Po1 used to control the polarity of the data voltages output from the source driver 230.

Each of the first source voltage output unit 231 and the second source voltage output unit 232 includes a first input terminal IN1 receiving the positive (+) polarity data voltage +VD and a second input terminal IN2 receiving the negative (−) polarity data voltage −VD.

The positive (+) polarity data voltage +VD and the negative (−) polarity data voltage −VD are data voltages corresponding to the image signals R', G', B'.

Since the level of the data voltages is substantially the same as the level of the target voltage, the positive (+) polarity data voltage and the negative (−) polarity data voltage will be assigned with the same reference numerals as the positive (+) polarity target voltage and the negative (−) polarity target voltage.

The first source voltage output unit 231 alternately outputs the positive (+) polarity data voltage and the negative (−) polarity data voltage in response to the polarity control signal Po1 in the order of the positive (+) and negative (−) data voltages or the negative (−) and positive (+) data voltages through the odd-numbered data lines DL1, DL3, . . . , DLm−1.

The second source voltage output unit 232 alternately outputs the positive (+) polarity data voltage and the negative (−) polarity data voltage in response to the polarity control signal Po1 in the order of the negative (−) and positive (+) data voltages or the positive (+) and negative (−) data voltages through the even-numbered data lines DL2, DL4, . . . , DLm. That is, the second source voltage output unit 232 outputs the data voltages having the opposite polarity to the polarity of the data voltages output from the first source voltage output unit 231 in response to the polarity control signal Po1.

The first switch circuit 233 switches the first input terminal IN1 and the second input terminal IN2 of the first source voltage output unit 231 in response to the polarity control signal Po1. The second switch circuit 234 switches the first input terminal IN1 and the second input terminal IN2 of the second source voltage output unit 232 in response to the polarity control signal Po1.

Referring to FIG. 6, the first source voltage output unit 231 outputs the positive (+) polarity data voltage +VD, which is provided through the first input terminal IN1, through the odd-numbered data lines DL1, DL3, . . . , DLm−1 in response to the polarity control signal Po1. In this case, the first switch circuit 233 is connected to the first input terminal IN1 of the first source voltage output unit 231 in response to the polarity control signal Po1 and outputs the positive (+) polarity data voltage +VD as the first voltage VD1.

The second source voltage output unit 232 outputs the data voltages having the opposite polarity to the polarity of the data voltages output from the first source voltage output unit 231. Thus, the second source voltage output unit 232 outputs the negative (−) polarity data voltage −VD, which is provided through the second input terminal IN2, through the even-numbered data lines DL2, DL4, . . . , DLm in response to the polarity control signal Po1. In this case, the second switch circuit 234 is connected to the second input terminal IN2 of the second source voltage output unit 232 in response to the polarity control signal Po1 and outputs the negative (−) polarity data voltage −VD as the second voltage VD2.

Although not shown in FIG. 6, in the case that the negative (−) polarity data voltage −VD is output from the first source voltage output unit 231, the first switch circuit 233 is connected to the second input terminal IN2 of the first source voltage output unit 231 in response to the polarity control signal Po1. Therefore, the first switch circuit 233 outputs the negative (−) polarity data voltage −VD as the first voltage VD1. In this case, the second source voltage output unit 232 outputs the positive (+) polarity data voltage +VD and the second switch circuit 234 is connected to the first input terminal IN1 of the second source voltage output unit 232 in response to the polarity control signal Po1. Thus, the second switch circuit 234 outputs the positive (+) polarity data voltage +VD as the second voltage VD2.

However, the operation of the switch circuits should not be limited to the above-mentioned manner. That is, the switch circuits may be controlled by a separated control signal provided from the timing controller.

The first voltage VD1 and the second voltage VD2 output from the first source voltage output unit 231 and the second source voltage output unit 232 are applied to the sub-source driver 240, and the operation of the display apparatus 200 after the first and second voltages VD1 and VD2 are applied to the sub-source driver 240 is substantially the same as the above-mentioned operation.

Figure 7:
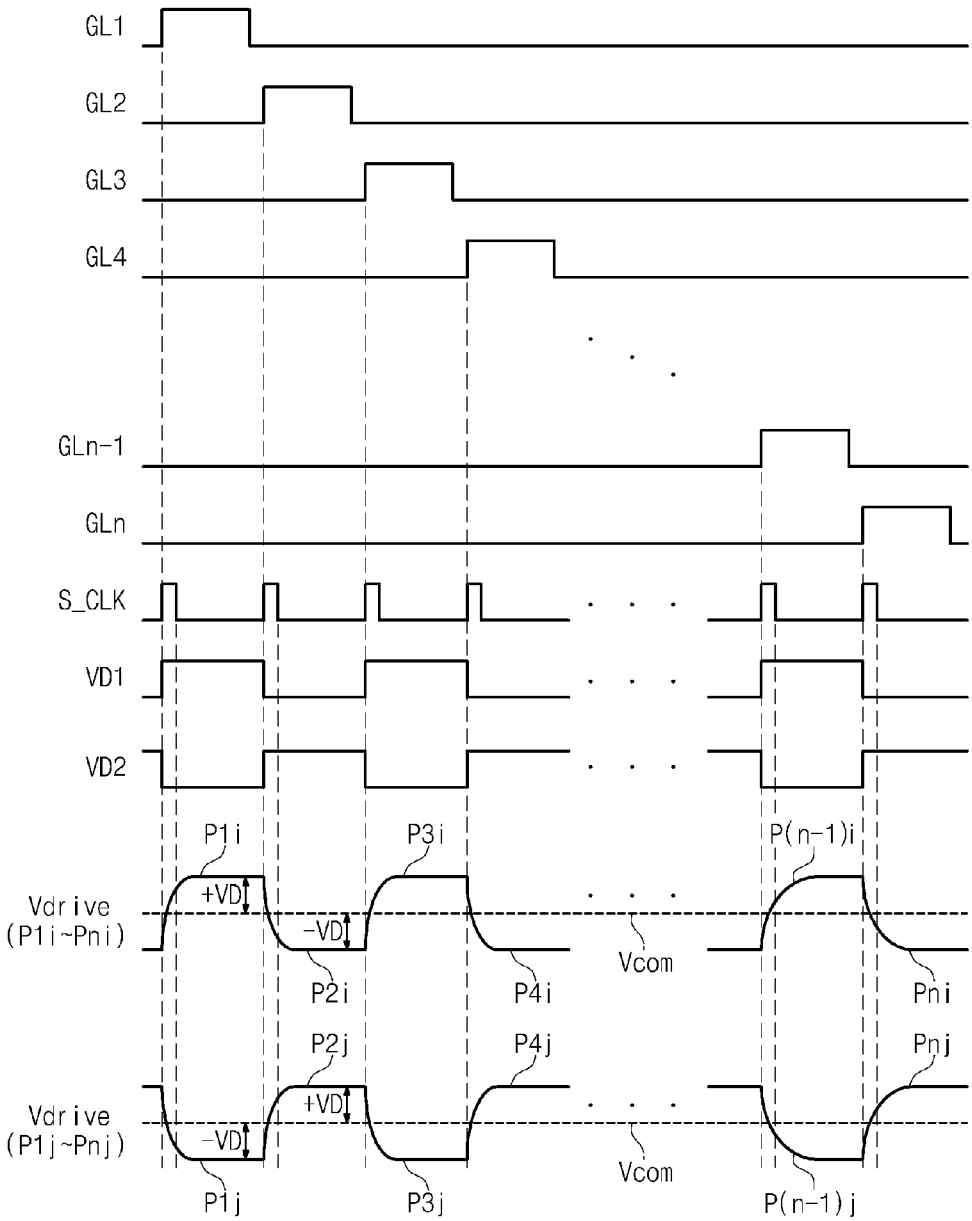
FIG. 7 is a timing diagram illustrating an operation of the display apparatus shown in FIG. 4.

FIG. 7 is a timing diagram illustrating an operation of the display apparatus shown in FIG. 4. FIG. 7 shows voltage waveforms of the gate signal, the sub-clock signal, the is first data voltage, the second data voltage, and the nodes of the odd- and even-numbered data lines.

Since application timings of the gate signals and the sub-clock signal S_CLK are substantially the same as those of the gate signals and the sub-clock signal S_CLK shown in FIG. 2, details thereof will be omitted.

Referring to FIG. 7, the sub-source driver 240 outputs the first voltage VD1 and the second voltage VD2 in response to the sub-clock signal S_CLK at every time period when the gate signals are applied to the pixels PX.

As described above, the first voltage VD1 has the same level and the same polarity as those of the data voltages output from the source drive 230 through the odd-numbered data lines DL1, DL3, . . . , DLm−1. The second voltage VD2 has the same level and the same polarity as those of the data voltages output from the source drive 230 through the even-numbered data lines DL2, DL4, . . . , DLm. Accordingly, as shown in FIG. 7, the positive (+) first voltage VD1 and the negative (−) first voltage VD1 are alternately output and the negative (−) second voltage VD2 and the positive (+) second voltage VD2 are alternately output.

The first voltage VD1 is output to the lower portion of the display panel 210 from the sub-source driver 240 through the odd-numbered data lines DL1, DL3, . . . , DLm−1. In addition, the second voltage VD2 is output to the lower portion of the display panel 210 from the sub-source driver 240 through the even-numbered data lines DL2, DL4, . . . , DLm.

The nodes P1*i* to Pni shown in FIG. 7 are included in one odd-numbered data line of the odd-numbered data lines DL1, DL3, . . . , DLm−1, and the nodes P1*j* to Pnj shown in FIG. 7 are included in one even-numbered data line of the even-numbered data lines DL2, DL4, . . . , DLm.

The gray scale-driving voltage of the nodes P11 to Pnm of the data lines DL1 to DLm is provided to the pixels PX during the high level period G_H of the corresponding gate signal.

As described above, the propagation time delay of the data lines is increased as the data lines are closer to the lower portion of the display panel 210. The propagation time delay of the data lines is maximized at the n-th nodes Pni and Pnj of the data lines DL1 to DLm. However, as described above, the first voltage VD1 and the second voltage VD2 are output to the lower portion of the display panel 210 through the data lines DL1 to DLm during the high level period of the sub-clock signal S_CLK.

Accordingly, as shown in FIG. 7, the gray scale-driving voltage Vdrive of the n-th node Pni of the odd-numbered data line is precharged to a predetermined voltage level lower than the common voltage Vcom during the high level period of the sub-clock signal S_CLK. In addition, as shown in FIG. 7, the gray scale-driving voltage Vdrive of the n-th node Pnj of the even-numbered data line is precharged to a predetermined voltage level higher than the common voltage Vcom during the high level period of the sub-clock signal S_CLK.

The high level period of the sub-clock signal S_CLK may be set to a time period during which the gray scale-driving voltage Vdrive of the nodes is precharged to the predetermined voltage level higher or lower than the common voltage Vcom.

The gray scale-driving voltage Vdrive of each of the n-th nodes Pni and Pnj falls down to the negative (−) polarity target voltage −VD from the voltage level percharged to the predetermined voltage level or rises up to the positive (+) polarity target voltage +VD from the voltage level percharged to the predetermined voltage level. That is, as shown in FIG. 7, the gray scale-driving voltage Vdrive of the n-th node Pni of the odd-numbered data line may fall down to the negative (−) polarity target voltage −VD during the high level period G_H of the gate signal. In addition, as shown in FIG. 7, the gray scale-driving voltage Vdrive of the n-th node Pnj of the even-numbered data line may rise up to the positive (+) polarity target voltage +VD during the high level period G_H of the gate signal.

As described above, the propagation time delay of the data lines is reduced as the data lines are closer to the upper portion of the display panel 210 and the propagation time delay of the data lines is shortened at the first nodes P1*i* and P1*j* of the data lines DL1 to DLm.

Thus, as shown in FIG. 7, the gray scale-driving voltage Vdrive of the first node P1*i* of the odd-numbered data line may rise up to the positive (+) polarity target voltage +VD during the high level period G_H of the gate signal. In addition, as shown in FIG. 7, the gray scale-driving voltage Vdrive of the first node P1*j* of the even-numbered data line may fall down to the negative (−) polarity target voltage −VD during the high level period G_H of the gate signal.

The first nodes P1*i* and P1*j* are precharged to the predetermined voltage level by the first voltage VD1 and the second voltage VD2 provided from the sub-source driver 240. The precharge operation of the first nodes P1*i* and P1*j* will be described in detail with reference to FIG. 8A and FIG. 8B.

The pixels PX receive the gray scale-driving voltage Vdrive of the nodes P11 to Pnm, which falls down to the negative (−) polarity target voltage −VD or rises up to the positive (+) polarity target voltage +VD, and display the gray scale level corresponding to the gray scale-driving voltage Vdrive.

The data voltages are applied to the upper portion of the display panel 210 through the data lines DL1 to DLm during the high level period G_H of the gate signal. In addition, the first voltage VD1 and the second voltage VD2 are applied to the lower portion of the display panel 210 through the data lines DL1 to DLm during the high level period of the sub-clock signal S_CLK. Therefore, the display apparatus 100 operates in a dual data driving scheme.

Figure 8A:
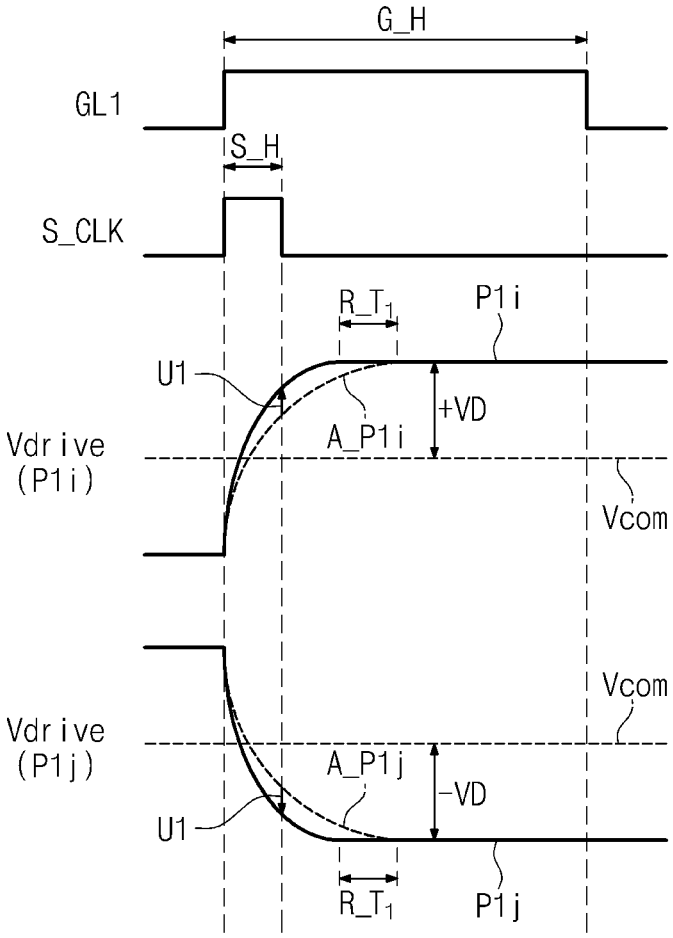
FIG. 8A is an enlarged waveform diagram showing a voltage waveform at a first node and an n-th node of odd-numbered data lines shown in FIG. 7.
Figure 8B:
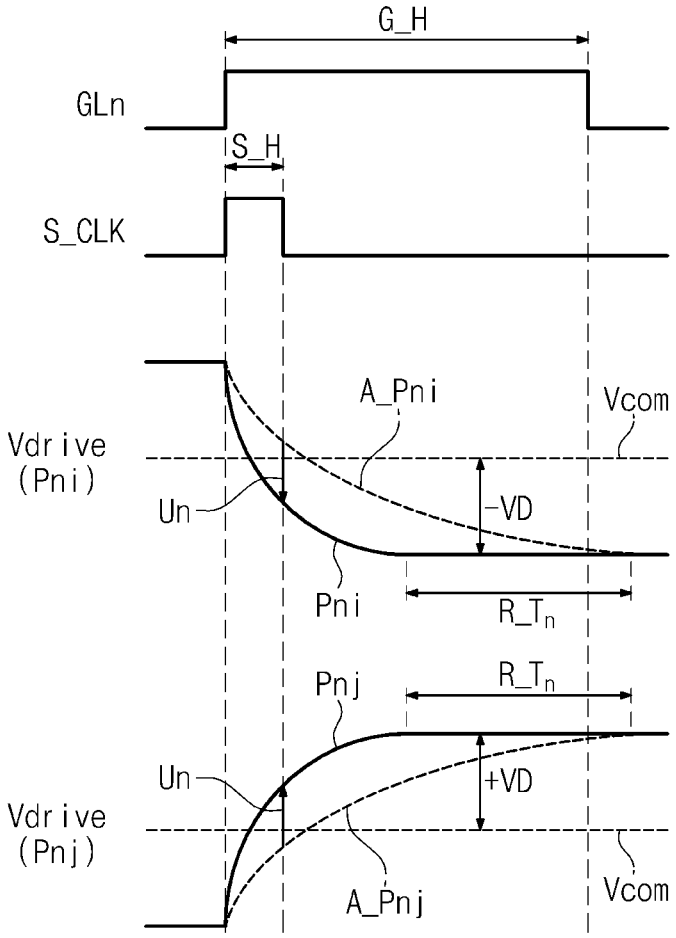
FIG. 8B is an enlarged waveform diagram showing a voltage waveform at a first node and an n-th node of even-numbered data lines shown in FIG. 7.

FIG. 8A is an enlarged waveform diagram showing the voltage waveform at the first node and the n-th node of odd-numbered data lines shown in FIG. 7, and FIG. 8B is an enlarged waveform diagram showing the voltage waveform at the first node and the n-th node of even-numbered data lines shown in FIG. 7.

FIGS. 8A and 8B show the voltage waveform of the first nodes A_P1*i* and A_Pni and the n-th nodes A_Pni and A_Pnj of the odd-numbered data line and the even-numbered data line when assuming that the display apparatus 200 does not include the sub-source driver 240.

Referring to FIG. 8A, the gray scale-driving voltage Vdrive of the first node P1*i* of the odd-numbered data line is precharged to the predetermined positive (+) voltage level during the high level period of the sub-clock signal S_CLK. In addition, the gray scale-driving voltage Vdrive of the first node P1*j* of the even-numbered data line is precharged to the predetermined negative (−) voltage level during the high level period of the sub-clock signal S_CLK.

A difference between the voltage level of the nodes when the display apparatus 200 does not include the sub-source driver 240 and the voltage level of the nodes when the display apparatus 200 includes the sub-source driver 240 may be defined as an increase period. In addition, the increase period from the first nodes P1*i* and P1*j* to the n-th nodes Pni and Pnj may be defined as from a first increase period U1 to an n-th increase period Un.

A difference between a time period in which the voltage level of the nodes reaches the target voltage when the display apparatus 210 does not include the sub-source driver 240 and a time period in which the voltage level of the nodes reaches the target voltage when the display apparatus 210 includes the sub-source driver 240 may be defined as a decrease time period. In addition, the decrease time period from the first nodes P1*i* and P1*j* to the n-th nodes Pni and Pnj may be defined as from a first decrease time period R_T1 to an n-th decrease time period R_Tn.

The gray scale-driving voltage Vdrive of the first node P1*i* of the odd-numbered data line is precharged to a voltage level increased than the voltage of the first node A_P1*i*, which is obtained in the case that the sub-source driver 240 does not exist, by the first increase period U1 during the high level period S_H of the sub-clock signal S_CLK.

In addition, the gray scale-driving voltage Vdrive of the first node P1*j* of the even-numbered data line is precharged to a voltage level decreased than the voltage of the first node A_P1*j*, which is obtained in the case that the sub-source driver 240 does not exist, by the first increase period U1 during the high level period S_H of the sub-clock signal S_CLK.

As the data lines are closer to the upper portion of the display panel 210, on the contrary to the decrease of the delay of the data lines with respect to the data voltage, the delay of the data lines with respect to the first voltage VD1 increases. That is, during the high level period S_H of the sub-clock signal S_CLK, the propagation time delay of the first voltage VD1 is increased as the data lines are closer to the upper portion of the display panel 210. Thus, as the data lines are closer to the upper portion of the display panel 210, the level of the first voltage VD 1 used to precharge the nodes during the high level period S_H of the sub-clock signal S_CLK is decreased. As a result, the increase period increased by the first voltage VD1 gradually decreases as the data lines are closer to the upper portion of the display panel 210. In detail, the first increase period U1 is smallest at the first nodes P1*i* and P1*j* and the n-th increase period Un is largest at the n-th nodes Pni and Pnj.

Consequently, the first nodes P1*i* and P1*j* of the odd- and even-numbered data lines may be precharged by the first voltage VD1.

The voltage of the first node P1*i* of the odd-numbered data line rises up from the precharged voltage level by the first voltage VD1 to the positive (+) polarity target voltage +VD during the high level period G_H of the gate signal. In addition, the voltage of the first node P1*j* of the even-numbered data line falls down from the precharged voltage level by the first voltage VD1 to the negative (−) polarity target voltage −VD during the high level period G_H of the gate signal.

As a result, as shown in FIG. 8A, a time period during which the gray scale-driving voltage Vdrive of the first node P1*i* of the odd-numbered data line increases to the positive (+) polarity target voltage +VD may be reduced by the first decrease time period R_T1 than a time period during which the gray scale-driving voltage Vdrive of the first node P1*i* of the odd-numbered data line increases to the positive (+) polarity target voltage +VD when the display apparatus 200 does not include the sub-source driver 240. Similarly, a time period during which the gray scale-driving voltage Vdrive of the first node P1*j* of the even-numbered data line decreases to the negative (−) polarity target voltage −VD may be reduced by the first decrease time period R_T1 than a time period during which the gray scale-driving voltage Vdrive of the first node P1*j* of the even-numbered data line decreases to the negative (−) polarity target voltage −VD when the display apparatus 200 does not include the sub-source driver 240.

Referring to FIG. 8B, the gray scale-driving voltage Vdrive of the n-th node Pni of the odd-numbered data line is precharged to the predetermined negative (−) voltage level during the high level period S_H of the sub-clock signal S_CLK. In addition, the gray scale-driving voltage Vdrive of the n-th node Pnj of the even-numbered data line is precharged to the predetermined positive (+) voltage level during the high level period S_H of the sub-clock signal S_CLK.

The gray scale-driving voltage Vdrive of the n-th node Pni of the odd-numbered data line is precharged to a voltage level decreased than the voltage of the n-th node A_Pni, which is obtained in the case that the sub-source driver 240 does not exist, by the n-th increase period Un during the high level period S_H of the sub-clock signal S_CLK.

In addition, the gray scale-driving voltage Vdrive of the n-th node Pnj of the even-numbered data line is precharged to a voltage level increased than the voltage of the n-th node A_Pnj, which is obtained in the case that the sub-source driver 240 does not exist, by the n-th increase period Un during the high level period S_H of the sub-clock signal S_CLK.

As described above, the first increase period U1 is smallest at the first nodes P1*i* and P1*j* and the n-th increase period Un is largest at the n-th nodes Pni and Pnj.

The gray scale-driving voltage of the n-th nodes Pni of the odd-numbered data line falls down from the precharged voltage level by the second voltage VD2 to the negative (−) polarity target voltage −VD and the gray scale-driving voltage of the n-th node Pnj of the even-numbered data line rises up from the precharged voltage level by the second voltage VD2 to the positive (+) polarity target voltage +VD.

As a result, as shown in FIG. 8B, a time period during which the gray scale-driving voltage Vdrive of the n-th node Pni of the odd-numbered data line decreases to the negative (−) polarity target voltage −VD may be reduced by the n-th decrease time period R_Tn than a time period during which the gray scale-driving voltage Vdrive of the n-th node Pni of the odd-numbered data line decreases to the negative (−) polarity target voltage −VD when the display apparatus 200 does not include the sub-source driver 240. Similarly, a time period during which the gray scale-driving voltage Vdrive of the n-th node Pnj of the even-numbered data line increases to the positive (+) polarity target voltage +VD may be reduced by the n-th decrease time period R_Tn than a time period during which the gray scale-driving voltage Vdrive of the n-th node Pnj of the even-numbered data line increases to the positive (+) polarity target voltage +VD when the display apparatus 200 does not include the sub-source driver 240. The decrease period is proportional to the increase period at the nodes P11 to Pnm of each of the data lines DL1 to DLm.

Due to the operation, the pixels PX receive the gray scale-driving voltage Vdrive of the positive (+) and negative (−) target voltages +VD and −VD of the nodes P11 to Pnm and display the gray scale level corresponding to the gray scale-driving voltage Vdrive.

Consequently, the display apparatus 200 may apply the normal data voltage to the pixels PX regardless of the propagation time delay of the data lines DL1 to DLm. Thus, the pixels PX may display the normal gray scale level corresponding to the data voltage.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a display panel comprising a plurality of gate lines, a plurality of data lines, and a plurality of pixels connected to the gate lines and the data lines;

a timing controller to generate a gate control signal, a data control signal, and a clock signal;

a gate driver to sequentially apply a gate signal to the gate lines in response to the gate control signal;

a first source driver to apply a first data voltage to the data lines in response to the data control signal; and a second source driver disposed at an opposite side of the display panel from the first source driver with respect to the display panel, the second source driver being configured to apply a second data voltage to the data lines at every time period, at which the gate signal is applied to the gate lines, in response to the clock signal, wherein the pixels display a gray scale in response to the first data voltage and the second data voltage, a time period of a rising edge of the clock signal is the same as a time period of a rising edge of the gate signal, and the clock signal has a high level period shorter than a high level period of the gate signal.

2. The display apparatus of claim 1, wherein the gate signal is applied to a corresponding gate line of the gate lines in a present stage after a time interval lapses from when the gate signal is applied to a corresponding gate line of the gate lines in a previous stage.

3. The display apparatus of claim 2, wherein the clock signal has a period from a rising edge of the high level period of the gate signal applied to the gate line in the previous stage to a rising edge of the high level period of the gate signal applied to the gate line in a present stage.

4. The display apparatus of claim 1, wherein the second source driver comprises a plurality of transistors respectively corresponding to the data lines.

5. The display apparatus of claim 4, wherein each of the transistors comprises a drain electrode connected to a corresponding data line of the data lines, a gate electrode applied with the clock signal from the timing controller, and a source electrode applied with the second voltage.

6. The display apparatus of claim 5, wherein each of the transistors applies the second data voltage to the corresponding data line of the data lines in response to the clock signal.

7. The display apparatus of claim 1, wherein the first data voltage comprises a positive polarity data voltage and a negative polarity data voltage and the second data voltage has an intermediate level between the positive polarity data voltage and the negative polarity data voltage.

8. The display apparatus of claim 7, wherein each of the data lines comprises a plurality of nodes connected to the pixels.

9. The display apparatus of claim 8, wherein the nodes of the data lines applied with the positive polarity data voltage have a voltage level equal to or higher than the second data voltage during the high level period of the clock signal.

10. The display apparatus of claim 9, wherein the nodes of the data lines applied with the positive polarity data voltage have a target voltage level equal to the positive polarity data voltage during the high level period of the gate signal.

11. The display apparatus of claim 8, wherein the nodes of the data lines applied with the negative polarity data voltage have a voltage level equal to or lower than the second data voltage during the high level period of the clock signal.

12. The display apparatus of claim 11, wherein the nodes of the data lines applied with the negative polarity data voltage have a target voltage level equal to the negative polarity data voltage during the high level period of the gate signal.

13. The display apparatus of claim 1, wherein the first data voltage comprises a positive polarity data voltage and a negative polarity data voltage, the second data voltage comprises a first voltage and a second voltage having a polarity opposite to a polarity of the first voltage, and the data control signal comprises a polarity control signal.

14. The display apparatus of claim 13, wherein the first source driver comprises:

a first source voltage output unit to alternately apply the positive polarity data voltage and the negative polarity data voltage to odd-numbered data lines of the data lines in response to the polarity control signal;

a second source voltage output unit to alternately apply the first data voltage of the opposite pole to the first data voltage, which are output from the first source voltage output unit, to even-numbered data lines of the data lines in response to the polarity control signal;

a first switch circuit to receive a voltage having the same polarity and the same level as the first data voltage output from the first source voltage output unit and outputs the voltage as the first voltage; and a second switch circuit to receive a voltage having the same polarity and the same level as the first data voltage output from the second source voltage output unit and outputs the voltage as the second voltage.

15. The display apparatus of claim 14, wherein each of the first and second source voltage output units comprises a first input terminal applied with the positive polarity data voltage and a second input terminal applied with the negative polarity data voltage, and each of the first and second source voltage output units is configured to output a different one of the positive polarity data voltage and the negative polarity data voltage in response to the polarity control signal.

16. The display apparatus of claim 15, wherein the first switch circuit is configured to switch the first and second input terminals of the first source voltage output unit in response to the polarity control signal, and the second switch circuit is configured to switch the first and second input terminals of the second source voltage output unit in response to the polarity control signal.

17. The display apparatus of claim 14, wherein the first switch circuit is configured to apply the first voltage to the second source driver, the second switch circuit is configured to apply the second voltage to the second source driver, and the second source driver is configured to apply the first voltage to the odd-numbered data lines in response to the clock signal and is configured to apply the second voltage to the even-numbered data lines in response to the clock signal.

18. The display apparatus of claim 14, wherein the second source driver comprises a plurality of transistors respectively corresponding to the data lines.

19. The display apparatus of claim 18, wherein each of the transistors comprises a drain electrode connected to a corresponding data line of the data lines and a gate electrode to receive the clock signal from the timing controller, each of odd-numbered transistors of the transistors comprises a source electrode to receive the first voltage, and each of even-numbered transistors of the transistors comprises a source electrode to receive the second voltage.

20. The display apparatus of claim 19, wherein each of the odd-numbered transistors is configured to apply the first voltage to the odd-numbered data lines in response to the clock signal.

21. The display apparatus of claim 19, wherein each of the even-numbered transistors is configured to apply the second voltage to the even-numbered data lines in response to the clock signal.

* * * * *